United States Patent [19]

Berty

[11] 4,158,639

[45] Jun. 19, 1979

[54] METHOD OF STORING GASES

[75] Inventor: Jozsef M. Berty, Erie, Pa.

[73] Assignee: Autoclave Engineers, Inc., Erie, Pa.

[21] Appl. No.: 851,116

[22] Filed: Nov. 14, 1977

[51] Int. Cl.[2] ..... G21F 9/02

[52] U.S. Cl. ..... 252/301.1 W; 176/37; 206/0.7; 250/432 R; 423/249

[58] Field of Search ..... 252/301.1 W; 423/249; 176/37; 206/0.7; 220/3; 250/432, 506, 507

[56] References Cited

U.S. PATENT DOCUMENTS 3,206,409 9/1965 Maue ..... 252/301.1 W 3,316,691 5/1967 Sesny et al. ..... 55/66

3,438,365 4/1969 Packer et al. ..... 250/432

*Primary Examiner*—Benjamin R. Padgett

*Assistant Examiner*—Deborah L. Kyle

*Attorney, Agent, or Firm*—Webb, Burden, Robinson & Webb

[57] ABSTRACT

Gases are stored by combining with a bed of capturing solids at elevated temperatures and pressures. The solids are placed in canisters which are then placed in an autoclave. The gases to be stored are fed directly to the canister via a conduit passing through the autoclave wall.

3 Claims, 1 Drawing Figure

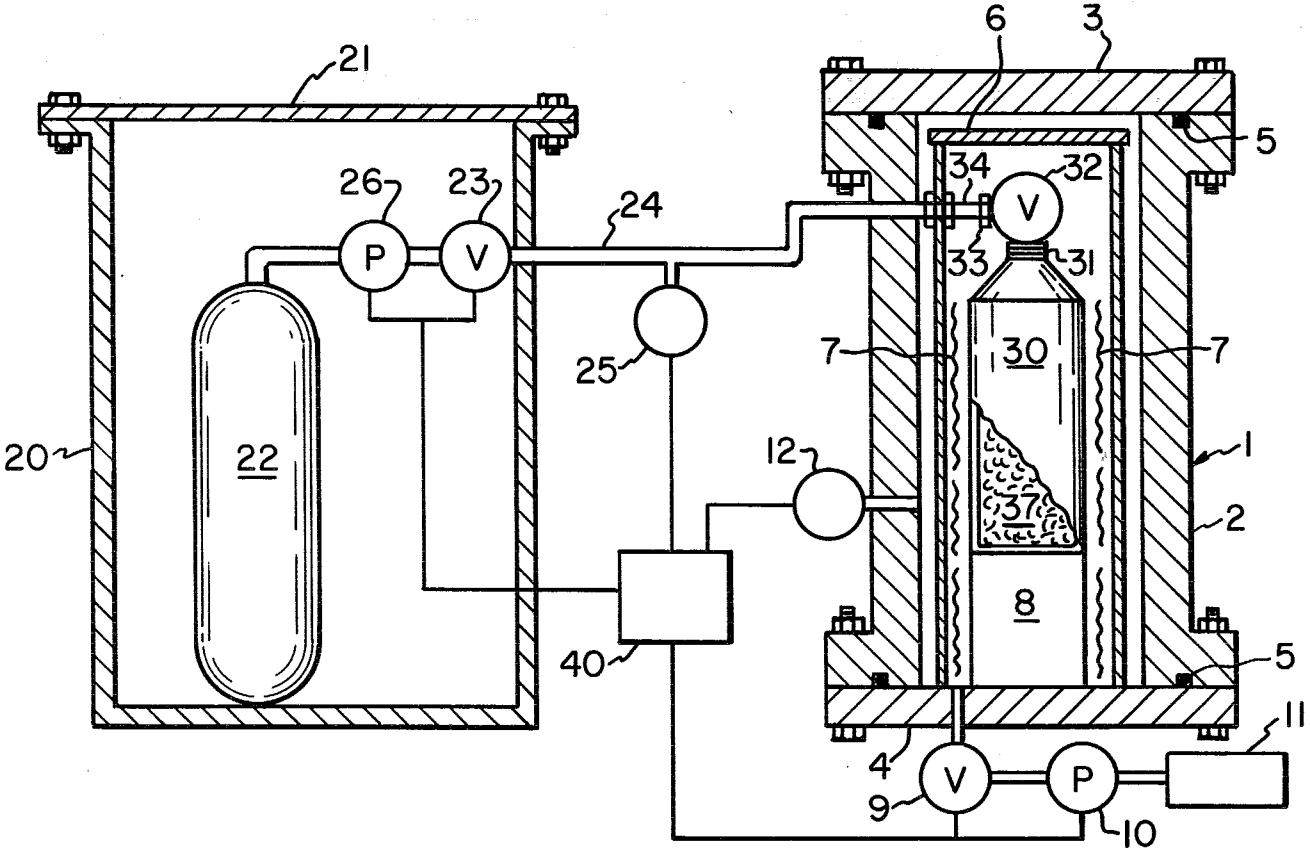
1
2
3
4
5
6
7
8
9
10
11
12
20
21
22
23
24
25
26
30
31
32
33
34
37
40
V
P

METHOD OF STORING GASES

BACKGROUND

This application relates to a process for the storing of gas by high temperature and pressure absorption, aadsorption or reaction with a capturing solid bed. In particular, the process relates to storing radioactive krypton ($^{85}Kr$) and other gases absorbed in zeolites. Other applications will become apparent to those skilled in the art.

The encapsulation of gases in zeolites is known and it has been taught that the encapsulation of radioactive krypton ($^{85}Kr$) takes place under high temperatures and pressures. (See Brown et al. "$^{85}Kr$ Storage by Zeolite Encapsulation," 14th ERDA Air Cleaning Conference). Following the absorption and cooling, the pressure may be lowered without the loaded zeolite releasing the krypton. The process suggested to date for encapsulation has a distinct drawback; namely, it cannot be carried out without contamination of the autoclave reaction vessel; and/or the atmosphere. For example, it has been proposed to place the zeolite in a mesh basket, to lower the basket into an autoclave and to pressurize the autoclave with krypton. After loading the zeolite, the excess krypton is pumped out of the autoclave and the basket is removed through the atmosphere and placed in a sealable container for storage. The possibilities for contamination of the atmosphere are many. Worse yet, the loaded zeolite can be exposed to moisture in the air. As krypton 85 decays, rubidium 85 is produced which can react with the absorped moisture to form a strong caustic and hydrogen. The caustic can cause corrosion of the container and the hydrogen can result in gas pressure buildup in the container.

It is an advantage according to this invention to provide a process for the encapsulation of radioactive gas or the like without exposing the atmosphere or even the interior of the autoclave to the dangerous gas. The process has application where it is desired to react gases with capturing solids at elevated temperatures and pressures.

SUMMARY OF THE INVENTION

Briefly, according to this invention, there is provided a process of storing gas by high temperature and pressure absorption, adsorption or reaction with the bed of capturing solids comprising a first step of placing the capturing solids in a relatively thin-walled container having an opening therein connectable to a conduit. The container need only be able to withstand small pressures across its body of say 25 psi. Preferably the container has a relatively large opening at the top for introducing the capturing solids to the container and a lid sealing the large opening. Built into the lid is a valve which, when opened, provides communication between the interior of the container or canister and a fitting connectable to a conduit. A second step of the process comprises placing the thin-walled container in a pressurizable autoclave. A third step comprises bringing the interior of the thin-walled canister into communication with a conduit extending through the walls of the autoclave and communicating with a source of the gas to be stored. Typically, this comprises a connection between the fitting above described and a fitting in the wall of the autoclave. A fourth step comprises simultaneously pressurizing the autoclave and the interior of the thin-walled vessel by pumping gas to be stored into the thin-walled vessel and inert gas into the autoclave external the thin-walled vessel. The gas to be stored is continuously pumped into the thin-walled vessel as it is being absorbed, adsorbed or reacted with the capturing solids. When the bed of solids can no longer capture additional gas, a fifth step comprises first cooling and thereafter depressurizing the autoclave and the thin-walled vessel. In a final step, the autoclave is opened; the conduit from the thin-walled vessel disconnected; the vessel is sealed and removed to provide a substantially nonpressurized container loaded with absorbed, adsorbed or reacted gases.

DETAILED DESCRIPTION

Further features and other objects and advantages of this invention will become apparent from the following detailed description made with reference to the drawing which is a schematic illustration of apparatus generally useful for practice of the herein described method.

Referring now to the drawing, there is shown an autoclave 1 having cylindrical sidewalls 2 and endpieces 3 and 4. (It should be understood) that the apparatus described herein is only exemplary of apparatus suitable for practice of the claimed methods. Numerous autoclave designs exist which, with some modifications can be made suitable for the practice of this invention.) The endpieces are held to flanges attached to the cylindrical sidewall by suitable fasteners. Seals 5 in the nature of O-rings are provided to insure that the vessel is pressure tight. Within the autoclave is an insulating hood 6. Preferably, the hood has a removable top cover. Electrical heating elements 7 are positioned along the inside of the hood. In the center of the vessel is a pedestal 8. The vessel endpiece 4 is provided with suitable lead-throughs (not illustrated) for the power lines to the heating elements and for thermocouples for measuring the temperature for control purposes. A pressurizing system for the vessel comprises a valve 9, a pump 10 and reservoir 11 for introducing high pressure gases into the vessel. What has been described to this point is an autoclave of the type used for hot isostatic pressing. The gas in the reservoir is usually argon to protect the electrical heating elements from oxidation. A pressure sensor 12 in communication with the interior of the autoclave provides an electrical output signal indicative of the pressure in the vessel.

Adjacent the high pressure vessel is a safety container 20 which has a removable cover 21. The safety container has a gas tank 22 for holding the supply gas or gas to be stored. It also contains a bidirectional pump 26 and valve 23. A conduit 24 passes between valve 23 and into the pressure vessel. A pressure sensor 25 is in communication with the conduit 24 which sensor provides an electrical output indicative of the pressure in the conduit 24.

According to this process. a canister is filled with a capturing solid 37 (shown in the breakaway portion of the canister 30) and is placed upon the pedestal 8 while the autoclave cover 3 and the hood cover are removed. The canister is provided with a sealable cover 31 to which is secured a gas valve 32 which when opened enables the interior of the canister to communicate with a fitting 33. A nipple 34 enables the fitting 33 to be connected to the conduit 24.

Where the particular process is the encapsulation of radioactive krypton, the canister 30 is filled with a zeolite. The canister is connected as shown in the drawing with the valve 32 in the open position. The autoclave is then closed and bolted. At this time, the canister 30 and the capturing solids 37 are heated within the hood 6 by the heating elements 7. When the temperatures is appropriate to absorption (say, over 500° C.), valves 9 and 23 are open and pumps 10 and 26 are activated so that the pressure of the vessel and the pressure within the canister are simultaneously raised. These pressures are monitored by the sensors 12 and 25 and any pressure differential is recognized by controller 40 which controls the pumps and valves to minimize the pressure difference across the canister wall. The pressures contemplated are in excess of 15,000 psi. At some time the pump 10 may stop and valve 9 close while the pump 22 continues to introduce krypton into the canister 30 as it is absorbed therein. When the krypton can no longer be introduced in the canister without raising the pressure thereof the capturing solid is considered loaded. At that time, the vessel is allowed to cool and the vessel and canister are evacuated maintaining the pressure differential constant until the atmospheric pressures are achieved inside and out of the canister. Then the autoclave cover is open and the valve 32 closed. Nipple 34 and conduit 24 can then be completely evacuated by pump 26 and valve 23 may be closed. The nipple 34 is then disconnected. The canister is ready for storage. In this way, neither of the atmosphere or the inside of the autoclave is ever exposed to radioactive krypton.

The advantages according to this invention result from the canister 30 having its own pressure connection protruding through the main vessel closure and thereby during pressurization only the canister internals are exposed to radioactive material. The fact that the canister 30 may be made from thin, that is, relatively non-pressure resistant materials is a considerable advantage in that it permits quick heat up and cool down.

Having thus described my invention with the detail and particularity required by the Patent Laws, what is desired protection by Letters Patent is set forth in the following claims.

I claim:

1. A method of storing gas by high temperature and pressure absorption, adsorption or reaction with a bed of capturing solids comprising the steps for (a) placing the capturing solids in a relatively thin-walled container having an opening therein connectable to a conduit, (b) placing the thin-walled container in a pressurizable autoclave, (c) bringing the opening in the thin-walled container into communication with a conduit extending through the walls of the autoclave and communicating with the source of gas to be stored, (d) heating and simultaneously pressurizing the autoclave and the interior of the thin-walled vessel by pumping gas to be stored into the thin-walled vessel as gas is absorbed, adsorbed or reacted with the bed of solids, (e) cooling and thereafter depressurizing the autoclave and the thin-walled vessel and its contents, and (f) opening the autoclave, sealing said vessel, disconnecting the conduit from the thin-walled vessel and removing a substantially non-pressurized container loaded with absorbed, adsorbed or reacted gases.

2. A method of storing radioactive krypton or the like by high temperature and pressure absorption with a bed of capturing zeolites comprising the steps for (a) placing the capturing zeolites in a relatively thin-walled container having an opening therein connectable to a conduit, (b) placing the thin-walled container in a pressurizable autoclave, (c) bringing the opening in the thin-walled container into communication with a conduit extending through the walls of the autoclave and communicating with the source of krypton, (d) heating and simultaneously pressurizing the autoclave and the interior of the thin-walled vessel by pumping krypton to be stored into the thin-walled vessel as gas is absorbed by the bed of zeolite, (e) cooling and thereafter depressurizing the autoclave and the thin-walled vessel and its contents, and (f) opening the autoclave, sealing said vessel, disconnecting the conduit from the thin-walled vessel, and removing a substantially non-pressurized container loaded with absorbed radioactive krypton.

3. A method according to claim 2 wherein in step (d) the contents of the autoclave are heated to a temperature in excess of 500° C. and the pressure in the autoclave is raised to at least 15,000 psi.

* * * * *